US006739318B2

(12) United States Patent
Nomura

(10) Patent No.: US 6,739,318 B2
(45) Date of Patent: May 25, 2004

(54) FUEL INJECTION APPARATUS FOR MARINE ENGINE

(75) Inventor: Kenichi Nomura, Kawasaki (JP)

(73) Assignee: Keihin Corporation, Tokyo (JP)

( * ) Notice: Subject to any disclaimer, the term of this patent is extended or adjusted under 35 U.S.C. 154(b) by 13 days.

(21) Appl. No.: 10/461,262

(22) Filed: Jun. 13, 2003

(65) Prior Publication Data

US 2004/0003796 A1 Jan. 8, 2004

(30) Foreign Application Priority Data

Jul. 5, 2002 (JP) ..... 2002-196625

(51) Int. Cl.[7] ..... F02M 41/00
(52) U.S. Cl. ..... 123/461; 123/516; 123/458
(58) Field of Search ..... 123/461, 457, 123/458, 445, 516

(56) References Cited

U.S. PATENT DOCUMENTS 5,115,784 A * 5/1992 Mito et al. ..... 123/516
5,647,331 A * 7/1997 Swanson ..... 123/516
5,722,374 A * 3/1998 Kidokoro et al. ..... 123/516

* cited by examiner

*Primary Examiner*—Bibhu Mohanty
(74) *Attorney, Agent, or Firm*—R. Neil Sudol; Henry Coleman; William Sapone

(57) ABSTRACT

In a fuel injection apparatus in which a pressure regulator is attached to a vapor separator, in order to make the vapor separator compact, to improve corrosion resistance of the pressure regulator and to maintain a stable pressure regulating operation for a long time period, a vapor separator is constituted by a chamber and a cover, a pressure regulator is arranged within a recess portion of the cover and above a fixed fuel liquid surface, the longitudinal axis of the pressure regulator is arranged in a state of being approximately parallel to the fuel liquid surface, a pressure fuel inflow passage is formed in the cover and is formed so as to be branched from a fuel discharge passage formed in the cover, and a vent hole of a spring chamber is open at a lower position in the gravitational direction.

1 Claim, 5 Drawing Sheets

FUEL INJECTION APPARATUS FOR MARINE ENGINE

BACKGROUND OF THE INVENTION

1. Field of the Invention

The present invention relates to a fuel injection apparatus used in a marine engine such as an outboard motor for sailing on the sea.

2. Description of Conventional Art

A description will be given of a first example of a conventional fuel injection apparatus for the marine engine with reference to FIG. 4.

Reference symbol T denotes a fuel tank in which fuel is stored, reference symbol V denotes a vapor separator within which a fixed fuel liquid surface X—X is formed, and reference symbol D denotes a fuel distribution pipe provided with fuel injection valves J injecting and supplying the fuel into an intake pipe of the engine.

Further, the vapor separator V is structured as follows.

Reference numeral 20 denotes a casing formed by a chamber 21 and a cover 22. The chamber 21 is formed in a cup shape with a upper mounting collar portion 21A and a lower closed end, the cover 22 is formed in a cup shape from a lower mounting collar portion 22A and an upper closed end, and a fuel storage space is formed by bringing the respective mounting collar portions 21A and 22A of the chambers 21 and the cover 22 into contact with each other.

Reference symbol F denotes a fixed liquid surface control mechanism which forms and keeps the fixed fuel liquid surface X—X within the vapor separator V. The fixed liquid surface control mechanism F is constituted by a valve seat 24 which is connected to an inflow passage 23 formed in the cover 22 and is open to the inside of the vapor separator V, a float valve 25 which opens and closes the valve seat 24, and a float 27 which is rotatably supported to an axis 26, swings in correspondence to a liquid surface height formed within the vapor separator V, and controls so as to open and close the valve seat 24 via the float valve 25.

Further, a high pressure fuel pump HP is arranged within the vapor separator V, and this fuel pump HP is constituted by a motor portion and a pump portion.

The fuel pump HP is provided with a fuel discharge hole 28 and a fuel suction hole 29, the fuel suction hole 29 is arranged so as to be below the fuel liquid surface X—X within the vapor separator V, and the fuel discharge hole 28 is arranged so as to be connected to a fuel discharge passage 30 provided in the cover 22.

Reference symbol R denotes a pressure regulator which regulates a fuel pressure to a predetermined pressure. The pressure regulator R is structured as follows. A diaphragm 33 is clamped between a lower housing 31 and an upper housing 32, a fuel chamber 34 is formed by the diaphragm 33 and the lower housing 31, and a spring chamber 35 is formed by the diaphragm 33 and the upper housing 32.

Further, a fuel inflow hole 36 and a return fuel hole 37 are open to the fuel chamber 34, and a return valve seat 38 is provided in an open end of the return fuel hole 37 to the fuel chamber 34.

An opening of the return valve seat 38 to the fuel chamber 34 is controlled by a valve body 39 which is synchronously moved together with the diaphragm 33.

Further, a spring 40 pressing the diaphragm 33 toward the fuel chamber 34 is provided compressedly within the spring chamber 35, and a vent hole 41 is open to the spring chamber 35. Further, the pressure regulator R is arranged on a top surface of the cover 22, and at this time, the fuel in flow hole 36 is arranged so as to be connected to a pressure fuel inflow passage 42 formed in the cover 22, and the return fuel hole 37 is arranged so as to be open to an inside of the vapor separator V.

The vapor separator V provided with the pressure regulator R mentioned above is connected to the other structures by passages in accordance with the following manner.

The fuel tank T and the inflow passage 23 of the vapor separator V are connected by a fuel inflow pipe 43, and a low pressure fuel pump LP is arranged in the fuel inflow pipe 43.

The fuel discharge passage 30 formed in the vapor separator V and connected to the fuel discharge hole 28 of the high pressure fuel pump HP is connected to the fuel distribution pipe D by a fuel discharge pipe 44.

The pressure fuel inflow passage 42 formed in the cover 22 and connected to the fuel inflow hole 36 of the pressure regulator R is connected to the fuel discharge pipe 44 by a regulator fuel pipe 45.

In accordance with the structure mentioned above, pressure of the fuel within the fuel tank T is increased by the low pressure fuel pump LP, and the fuel having the increased pressure is supplied into the casing 20 of the vapor separator V via the fuel inflow pipe 43, the inflow passage 23 and the valve seat 24, and forms and keeps the fixed fuel liquid surface X—X within the casing 20 by the fixed liquid surface control mechanism F constituted by the valve seat 24, the float valve 25 and the float 27.

On the other hand, pressure of the fuel stored within the vapor separator V is increased in pressure by the high pressure fuel pump HP, and is supplied into the fuel distribution pipe D via the fuel discharge hole 28, the fuel discharge passage 30 and the fuel discharge pipe 44, and at this time, the pressure of the fuel moving toward the fuel distribution pipe D is regulated to a predetermined pressure by the pressure regulator R.

That is, a part of the fuel flowing within the fuel discharge pipe 44 flows into the fuel chamber 34 of the pressure regulator R via the regulator fuel pipe 45, the pressure fuel inflow pipe 42 and the fuel inflow hole 36, is filled in the fuel chamber 34 so as to press up the valve body 39 via the diaphragm 33, and balances with a spring force of the spring 40 at set pressure (predetermined pressure), whereby it is possible to regulate the pressure of the fuel flowing within the fuel discharge pipe 44 to predetermined pressure.

On the other hand, the valve body 39 is moved upward, whereby the return valve seat 30 is released. Accordingly, the fuel within the fuel chamber 34 is discharged into the casing 20 of the vapor separator V via the return fuel hole 37.

A second example of the conventional fuel injection apparatus for the marine engine is shown in FIG. 5.

In this case, the same reference symbols are attached to the same structure parts as those in FIG. 4, and a description thereof will be omitted.

The second example is different from the first example in view of an arrangement of the pressure regulator R.

That is, the pressure regulator R is arranged within the casing 20 of the vapor separator V and at a position below the fixed fuel liquid surface X—X, and the lower housing 31 is arranged in a bottom portion 21B of the chamber 21.

Further, the pressure fuel inflow passage 42 provided in the chamber 21 connected to the fuel inflow hole 36 of the pressure regulator R is connected to the fuel distribution pipe D by the regulator fuel pipe 45.

Accordingly, the pressure of fuel flowing within the fuel distribution pipe D is controlled to predetermined fuel pressure by a pressure regulating operation of the pressure regulator R.

In accordance with the first example of the conventional fuel injection apparatus, the pressure regulator R is arranged on the cover 22 of the vapor separator V, whereby the following problems are generated.

That is, since at least upper housing 32 of the pressure regulator R protrudes from the cover 22 and is arranged so as to be directly exposed to the ambient air, it is necessary to apply a corrosion resisting or rust proofing treatment to the upper housing 32 or use a corrosion resisting material for the upper housing 32, whereby it is impossible to effectively reduce a manufacturing cost for the upper housing 32.

Further, since the vent hole 41 is pierced so as to be open to the upper housing 32, there is a risk that sea water enters into the spring chamber 35 of the pressure regulator R from the vent hole 41, whereby there is generated a problem that parts such as the spring 40 within the spring chamber 35 and a retainer clamping the diaphragm 33 are corroded.

In particular, in the case of the corrosion of the spring 40, a spring characteristic tends to be changed and there is a case that the pressure regulating operation of the pressure regulator is affected. Further, in the case that the upper housing 32 protrudes above the cover 22, it is hard to make a whole height of the vapor separator V small, so that a design freedom for arranging the vapor separator V within an engine cowling is low.

Further, in accordance with the second example of the conventional fuel injection apparatus, since the pressure regulator R is arranged at a position below the fuel liquid surface X—X of the vapor separator V, the spring chamber 35 and the chamber 21 are arranged below the fuel liquid surface X—X, and the spring chamber 35 communicates with the fuel within the chamber 21 via the vent hole 41. Further, the fuel within the chamber 21 is applied also to the return fuel hole 37 in the downstream side of the return valve seat 38.

In accordance with the structure mentioned above, when a great gravitational acceleration is applied to the vapor separator V at a time of driving the marine engine, the gravity of the fuel stored within the vapor separator V is greatly applied to the spring chamber 35 and the return fuel hole 37, whereby the pressing force of the spring 40 to the diaphragm 33 and the force applied to the valve body 39 from the return fuel hole 37 are changed, and an appropriate pressure regulating operation of the pressure regulator R is temporarily obstructed.

Further, since a piping length is necessarily increased in the regulator fuel pipe 45 communicating the pressure fuel inflow passage 42 connected to the fuel inflow hole 36 of the pressure regulator R with the fuel distribution pipe D or the fuel discharge pipe 44, a freedom of arranging the vapor separator V within the engine cowling is inhibited.

SUMMARY OF THE INVENTION

A fuel injection apparatus for a marine engine in accordance with the present invention is made by taking the problem mentioned above into consideration, and an object of the present invention is to provide a vapor separator which can stably carry out a pressure regulating operation of a pressure regulator arranged in the vapor separator for a long time period, and is made compact so as to have a high freedom of being arranged within an engine cowling.

In order to achieve the object mentioned above, in accordance with the present invention, there is provided a fuel injection apparatus for a marine engine in which pressure of fuel within a fuel tank is increased by a low pressure fuel pump, and the fuel is supplied into a vapor separator within which a fixed fuel liquid surface is formed, and in which pressure of fuel within the vapor separator is increased by a high pressure fuel pump and is regulated to predetermined fuel pressure by a pressure regulator, and the fuel having the predetermined pressure is supplied toward a fuel injection valve, wherein a casing of the vapor separator is formed by bringing a chamber which is formed in a cup shape and is open in the upper side, into contact with a cover which is formed in a cup shape and is open in the lower side so as to close an upper opening of the chamber, and wherein the pressure regulator is arranged within a recess portion formed above a mounting collar portion of the cover and is arranged above the fixed fuel liquid surface and in a state in which the longitudinal axis of the pressure regulator is approximately parallel to the fuel liquid surface, a pressure fuel inflow passage toward the fuel chamber of the pressure regulator is formed so as to be branched from the fuel discharge passage within the cover, and a vent hole open to a spring chamber of the pressure regulator is open toward a lower position in the gravitational direction.

In accordance with the structure mentioned above, since the pressure regulator is arranged within the recess portion of the cover and above the fixed fuel liquid surface of the vapor separator, it is possible to shut off the pressure regulator from the ambient air.

Further, since the pressure regulator is arranged within the recess portion of the cover and in the state in which the longitudinal axis thereof is approximately parallel to the fuel liquid surface, it is possible to restrict an overall height of the vapor separator low.

Further, since the pressure fuel inflow passage is formed so as to be branched from the fuel discharge passage within the cover, it is possible to abolish the regulator fuel pipe and it is possible to make the fuel piping simple.

Further, since the pressure regulator is arranged above the fuel liquid surface within the recess portion, and the vent hole open to the spring chamber is open toward the lower position in the gravitational direction, it is possible to immediately discharge the fuel from the spring chamber even if the fuel enters into the spring chamber due to agitation of the fuel within the vapor separator.

DESCRIPTION OF THE PREFERRED EMBODIMENT

A description will be given of one embodiment of a fuel injection apparatus for a marine engine in accordance with the present invention with reference to the accompanying drawings.

Figure 1:
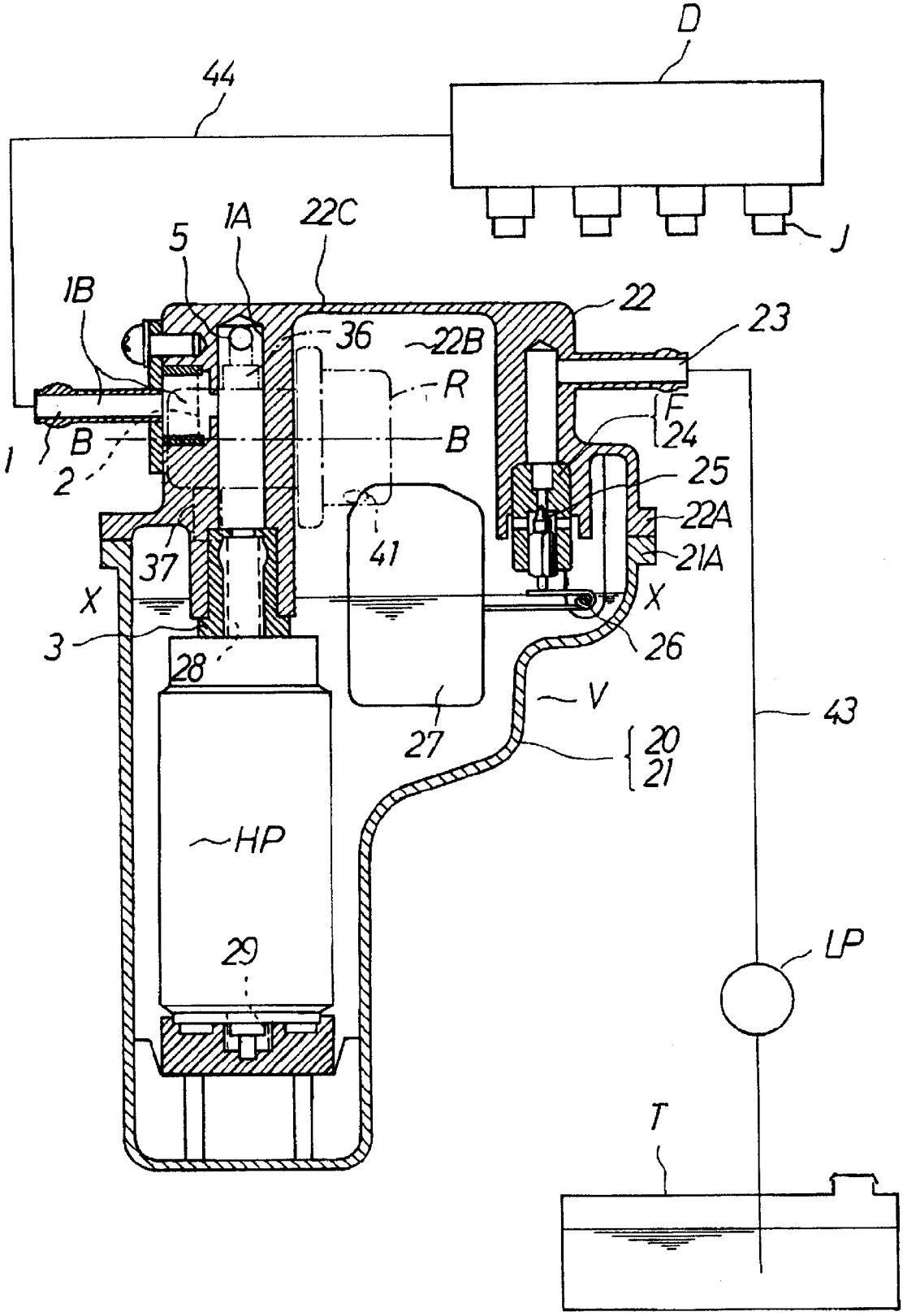
FIG. 1 is a system diagram including a vertical cross sectional view of a main portion showing one embodiment of a fuel injection apparatus for a marine engine in accordance with the present invention.

FIG. 1 is a system diagram of a fuel injection apparatus including a vapor separator.

Figure 2:
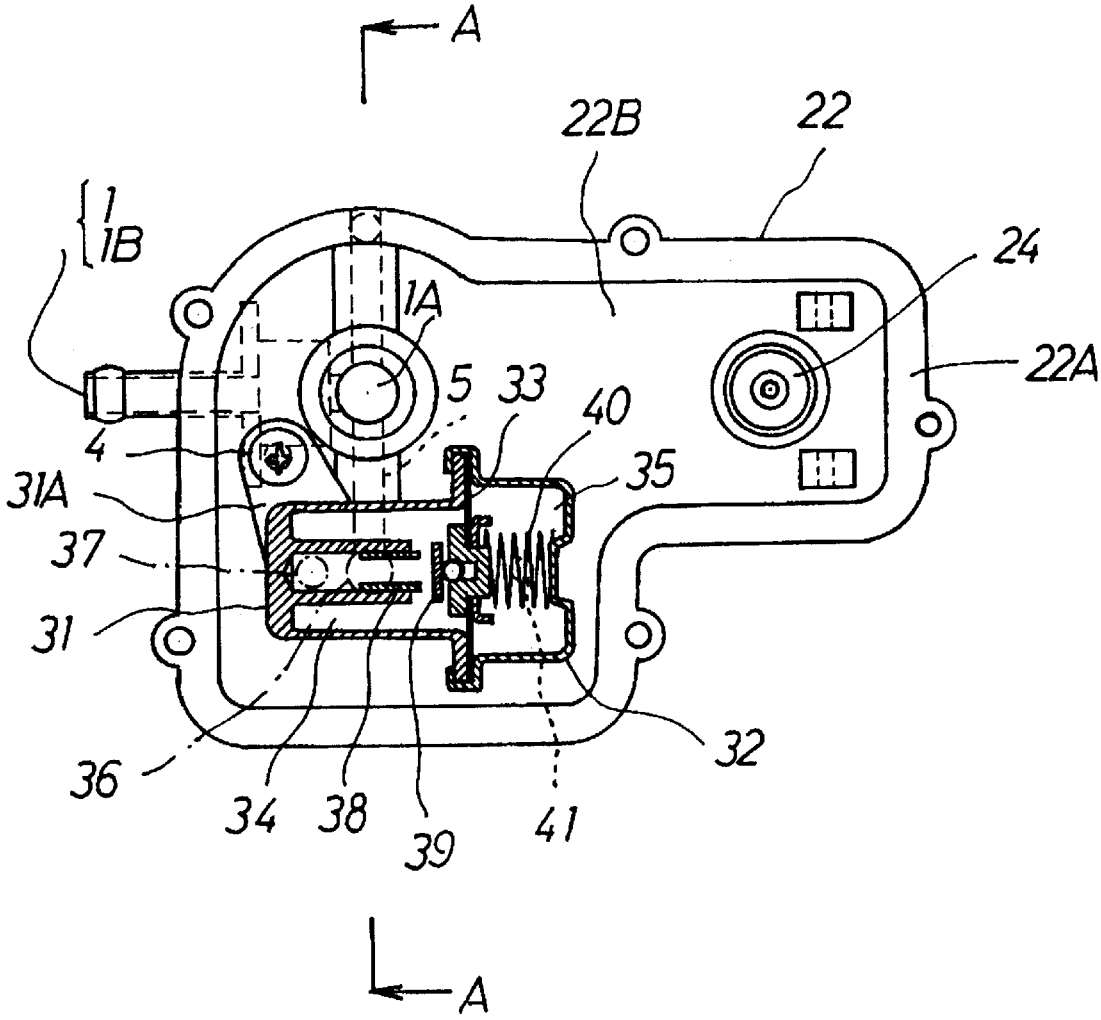
FIG. 2 is a bottom plan view in a state in which a pressure regulator is attached to a cover of a vapor separator in FIG. 1.

FIG. 2 is a bottom plan view in a state in which a pressure regulator is attached to a cover in FIG. 1.

Figure 3:
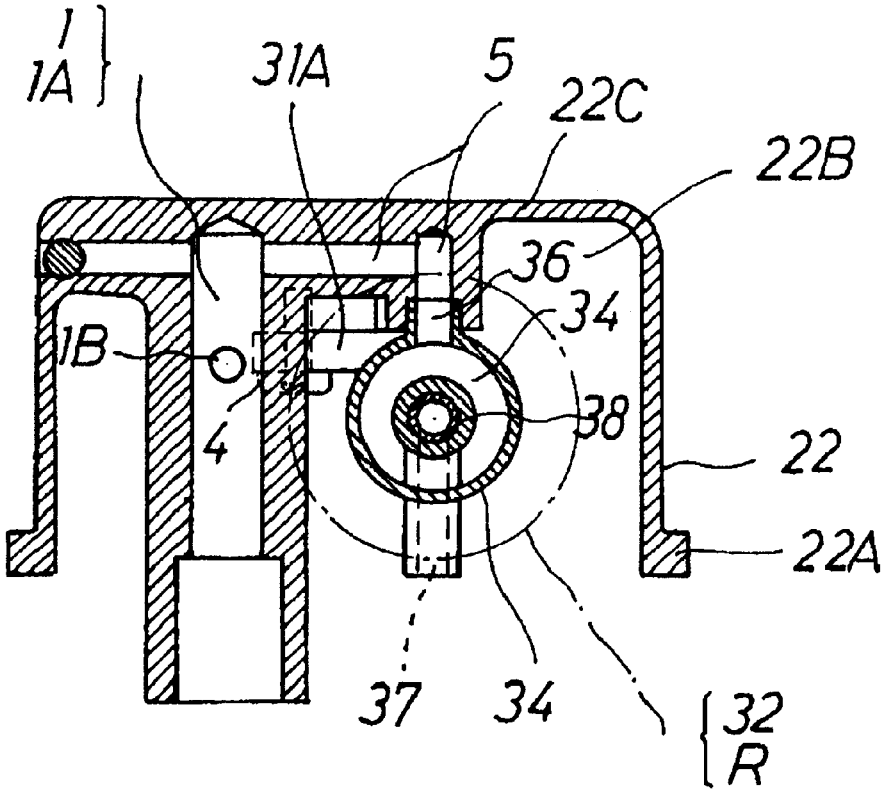
FIG. 3 is a vertical cross sectional view along a line A—A in FIG. 2.

FIG. 3 is a vertical cross sectional view along a line A—A in FIG. 2.

Figure 4:
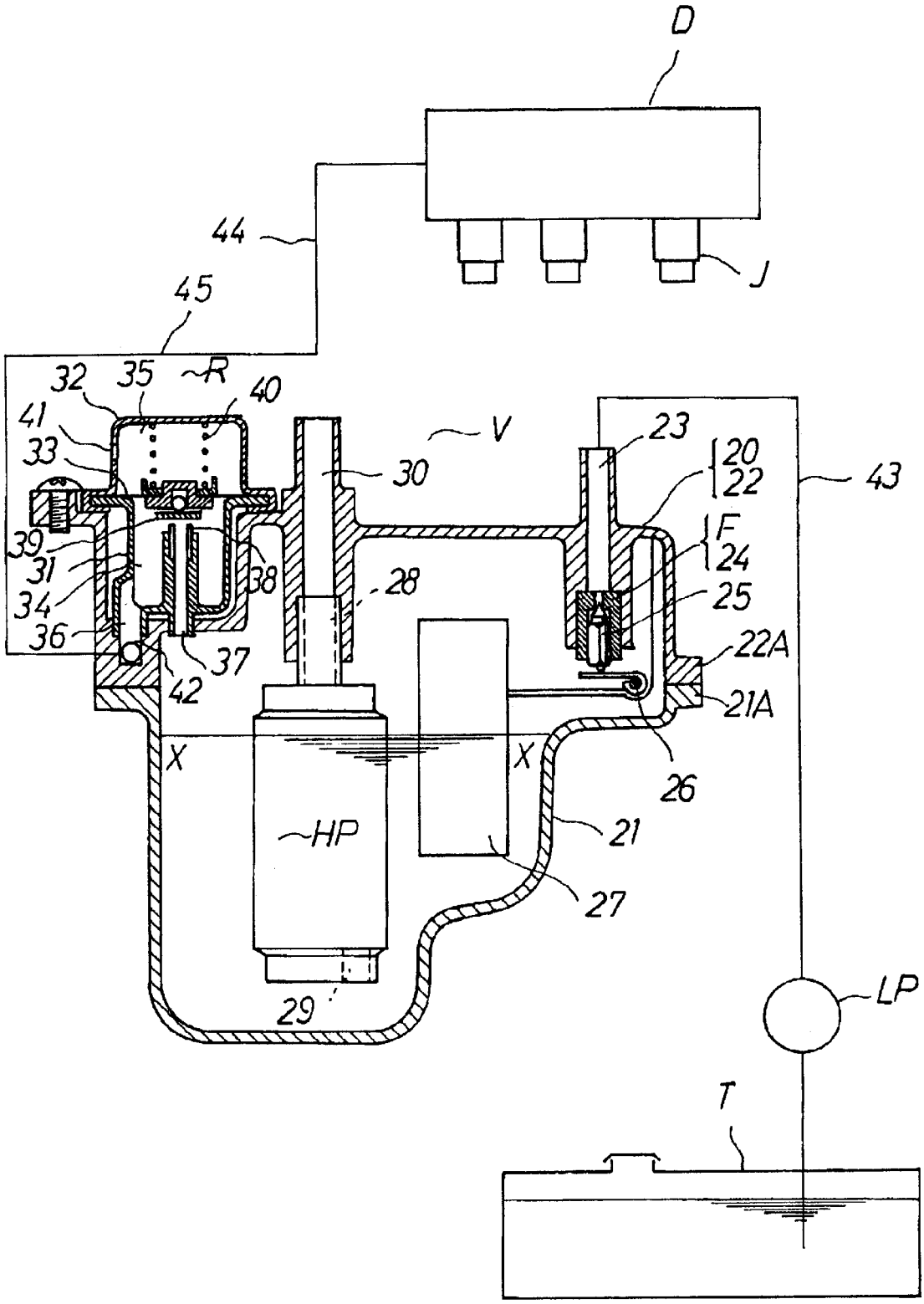
FIG. 4 is a system diagram showing a first example of a conventional fuel injection apparatus for a marine engine.
Figure 5:
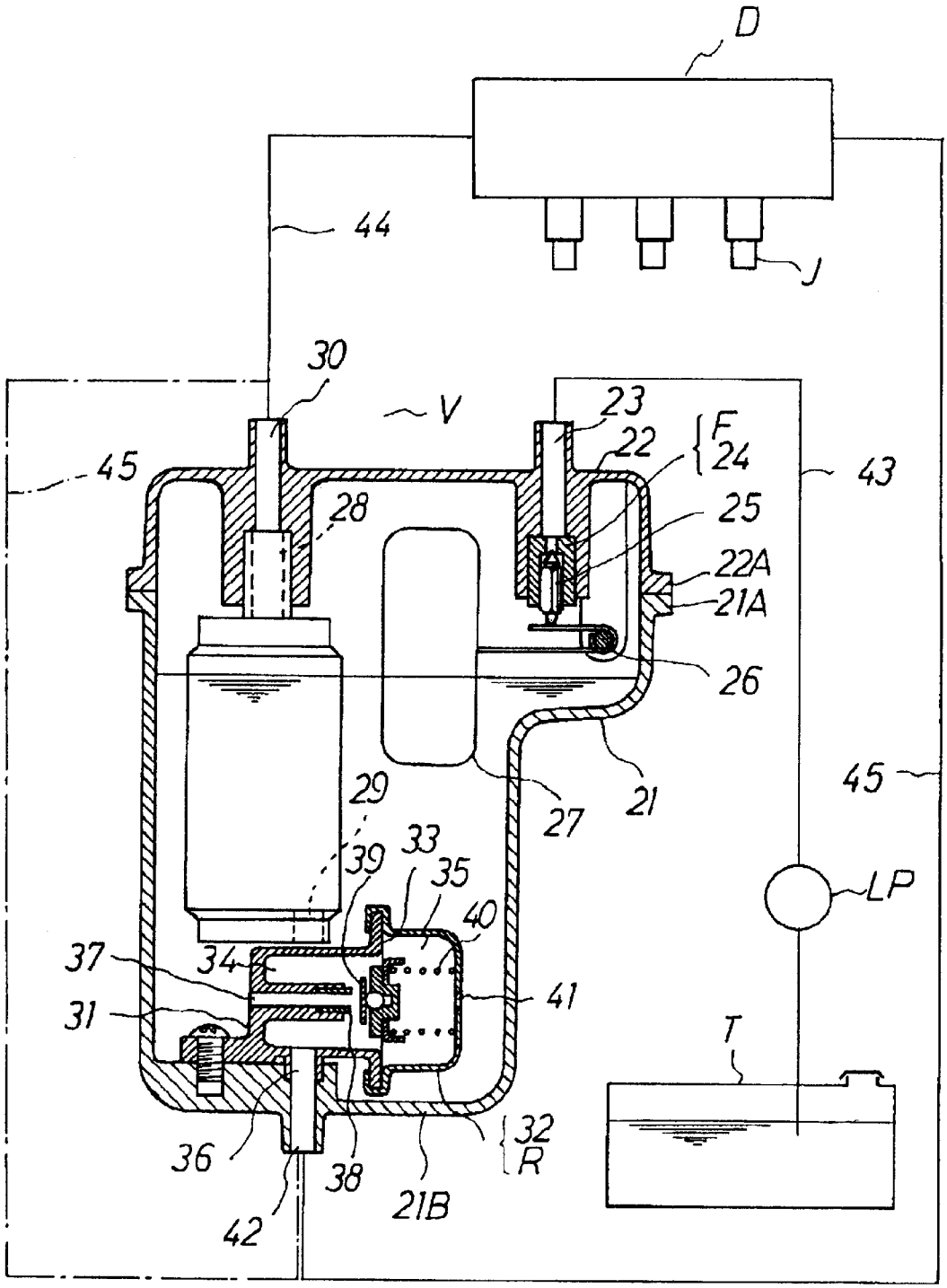
FIG. 5 is a system diagram showing a second example of the conventional fuel injection apparatus for the marine engine.

In this case, the same reference numerals are attached to the same structure parts as those in FIG. 4, and a description thereof will be omitted.

Reference numeral 1 denotes a fuel discharge passage formed in a cover 22. The fuel discharge passage is formed by a first fuel discharge passage 1A extending upward from the lower side of the cover 22, and a second fuel discharge passage 1B open leftward in FIG. 1 from an upper portion of the first fuel discharge passage 1A, and a filter 2 is arranged in the second fuel discharge passage 1B.

Further, a fuel discharge hole 28 of a high pressure fuel pump HP is inserted to a downward opening portion of the first fuel discharge passage 1A via a sealing packing 3 so as to be connected and arranged therein.

Further, a downstream side opening of the second fuel discharge passage 1B is connected to a fuel distribution pipe D via a fuel discharge pipe 44.

A structure itself of a pressure regulator R is the same as the conventional one, however, arrangement of the pressure regulator R and connection of flow passages have the following features.

That is, the pressure regulator R is arranged above a fixed fuel liquid surface X—X in the vapor separator V and within a recess portion 22B formed above the downward mounting collar portion 22A of the cover 22. Further, the longitudinal axis B—B of the pressure regulator R orthogonal to the diaphragm 33 is arranged in a state of being approximately parallel to the fuel liquid surface X—X.

More particularly, a collar portion 31A extending sideward from the lower housing 31 is screwed and fixed to a bottom portion 22C of the cover 22 via a screw 4.

Further, at the time of fixing as mentioned above, a fuel inflow hole 36 toward a fuel chamber 34 of the pressure regulator R is connected to a pressure fuel in flow passage 5 formed in the cover 22, and the pressure fuel inflow passage 5 is formed so as to be branched from the fuel discharge passage 1 formed in the cover 22.

More particularly, it is formed so as to be branched from the upper part of the first fuel discharge passage 1A.

Further, a vent hole 41 pierced in a spring chamber 35 is arranged so as to be open at a lower position in the gravitational direction.

In this case, a return fuel hole 37 connected to a return valve seat 38 is arranged so as to be open to the inside of the vapor separator V.

An arrangement state of the pressure regulator R in the cover 22 can be clearly understood by FIGS. 1, 2 and 3.

In accordance with the fuel injection apparatus provided with the pressure regulator R mentioned above, pressure of the fuel within the fuel tank T is increased by a low pressure fuel pump LP, and is supplied into the vapor separator V via a fuel inflow pipe 43, an inflow passage 23 and a valve seat 24, and a fixed fuel liquid surface X—X is formed and kept within the vapor separator V by a fixed liquid surface control mechanism F.

Further, pressure of the fuel stored within the vapor separator V is increased by the high pressure fuel pump HP, and is supplied to the fuel distribution pipe D via the fuel discharge hole 28, the first fuel discharge passage 1A, the second fuel discharge passage 1B and the fuel discharge pipe 44.

On the other hand, the fuel having increased by the high pressure fuel pump HP is supplied into the fuel chamber 34 of the pressure regulator R via the first fuel discharge passage 1A, the pressure fuel inflow passage 5 and the fuel inflow hole 36, whereby the fuel pressure is regulated in the same manner as the conventional manner, and the surplus fuel is discharged into the vapor separator V from the return fuel hole 37 without there turn valve seat being released by the valve body 38.

In this case, in accordance with the fuel injection apparatus on the basis of the present invention, since the pressure regulator R is arranged within the recess portion 22B of the cover 22 and is arranged above the fixed fuel liquid surface X—X stored within the vapor separator V, the pressure regulator R is not directly exposed to the external, whereby it is possible to largely improve a corrosion resistance against the sea water with respect to the lower housing 31 and the upper housing 32.

Further, since no sea water enters into the spring chamber 35 from the vent hole 41, it is particularly possible to inhibit the spring 40 from being corroded, and it is possible to inhibit the spring force of the spring from being changed. Further, since the pressure regulator R is not arranged so as to be dipped under the fuel liquid surface X—X, the fuel within the vapor separator V is not directly applied to the spring chamber 35 and the return fuel hole 37, whereby it is possible to stably regulate the fuel pressure even at a time when the fuel liquid surface within the vapor separator V is largely changed.

Further, since the pressure regulator R is arranged within the recess portion 22B of the cover 22 and in a state in which the longitudinal axis B-B of the pressure regulator R is approximately parallel to the fuel liquid surface X—X within the vapor separator V, it is possible to restrict a height of the vapor separator V low, and it is possible to improve a mounting property to the marine engine.

Further, since the pressure fuel inflow passage S toward the fuel chamber 34 of the pressure regulator R is provided in the cover 22 so as to be branched from the fuel discharge passage 1 provided in the cover 22, no new pipe is required, so that it is possible to reduce the number of the parts and arrange the outer appearance neatly.

Further, since the vent hole 41 open to the spring chamber 35 of the pressure regulator R is open toward a lower position in a gravitational direction, it is possible to immediately discharge the fuel from the spring chamber 35 into the vapor separator V even if the fuel enters into the spring chamber 35 via the vent hole 41 due to an agitation of the fuel within the vapor separator V, and no fuel stays within the spring chamber 35.

As described above, in accordance with the fuel injection apparatus for the marine engine on the basis of the present invention, in which the pressure regulator is arranged in the vapor separator, by functionally combining the structure that the pressure regulator is arranged within the recess portion of the cover and is arranged above the fixed fuel liquid surface, the structure that the longitudinal axis of the pressure regulator is arranged approximately in parallel to the fuel liquid surface, the structure that the pressure fuel inflow passage is provided in the cover and is formed so as to be branched from the fuel discharge passage formed in the cover, and the structure that the vent hole open to the spring chamber is open at a lower position in the gravitational direction, it is possible to arrange the vapor separator compact, it is possible to make the fuel piping simple, it is possible to improve the corrosion resistance of the pressure regulator attached to the vapor separator, and it is possible to keep a stable pressure regulating operation for a long time period without being affected by the liquid surface fluctuation within the vapor separator, particularly in the structure such as the marine engine in which the vapor separator is arranged within the engine cowling.

What is claimed is:

1. A fuel injection apparatus for a marine engine in which pressure of fuel within a fuel tank is increased by a low pressure fuel pump, and the fuel is supplied into a vapor separator within which a fixed fuel liquid surface is formed, and pressure of fuel within the vapor separator is increased by a high pressure fuel pump and is regulated to predetermined fuel pressure by a pressure regulator, and the fuel having the predetermined pressure is supplied toward a fuel injection valve, wherein a casing of the vapor separator is formed by bringing a chamber which is formed in a cup shape and is open in the upper side, into contact with a cover which is formed in a cup shape and is open in the lower side so as to close an upper opening of the chamber, and wherein the pressure regulator is arranged within a recess portion formed above a mounting collar portion of the cover and is arranged above the fixed fuel liquid surface and in a state in which the longitudinal axis of the pressure regulator is approximately parallel to said fuel liquid surface, a pressure fuel inflow passage toward the fuel chamber of the pressure regulator is formed so as to be branched from the fuel discharge passage within the cover, and a vent hole open to a spring chamber of the pressure regulator is open toward a lower position in the gravitational direction.

* * * * *